United States Patent [19]

Gross

[11] 3,939,505

[45] Feb. 24, 1976

[54] SELF-HINGED, BUOYANT WEIR PLATE FOR SKIMMERS

[76] Inventor: Richard S. Gross, 1618 Calle De Oro, Thousand Oaks, Calif. 91360

[22] Filed: Jan. 6, 1975

[21] Appl. No.: 538,739

[52] U.S. Cl. ..... 4/172.17; 210/169

[51] Int. Cl.[2]..... E04H 3/16; E04H 3/18; F16L 2/02

[58] Field of Search..... 4/172, 172.17, 172.18; 210/169, 127, 121

[56] References Cited

UNITED STATES PATENTS

| | | | |
|---|---|---|---|
| 2,826,307 | 3/1958 | Pace | 210/169 |
| 3,067,879 | 12/1962 | Baker | 210/169 X |
| 3,306,448 | 2/1967 | Baker | 210/121 |
| 3,316,934 | 5/1967 | Sowers | 210/169 X |
| 3,716,873 | 2/1973 | Blum | 4/172.17 |
| 3,792,499 | 2/1974 | Whitaker | 4/172.17 |

*Primary Examiner*—Henry K. Artis
*Attorney, Agent, or Firm*—Donald Diamond

[57] ABSTRACT

A one-piece buoyant weir plate for use in skimmers for swimming pools and the like is formed from a rectangular sheet of expanded plastic or like material with closed cellular structure. The plate is subdivided into two panels by means of a heat-pressed hinge seam, and retained in the skimmer channel by means of a rigid mounting member holding one of said panels against the base of the skimmer channel while permitting the other panel to float upwardly and to act as a self-regulating weir when subjected to a pressure differential by the action of the filtering system pump.

11 Claims, 7 Drawing Figures

SELF-HINGED, BUOYANT WEIR PLATE FOR SKIMMERS

BACKGROUND OF THE INVENTION

The invention relates to skimmer valves for filtering systems for swimming pools and the like. It relates, more particularly, to such valves wherein a single, self-hinging, buoyant element is employed as the control member.

Skimmer valves have been employed for the removal of debris from open fluid containers, especially swimming pools, for some time and generally incorporate a buoyant valve member hingable on an axis parallel to, and below, the fluid surface level. This buoyant valve member generally performs a dual function. When the pump of the filtering system is in operation, the valve acts as a weir over which a thin sheet of surface water is admitted into the valve suction chamber, carrying with it surface debris; with the pump inoperative, it acts as a non-return valve, preventing the re-entry of such surface debris from the suction chamber into the main fluid container.

Valves of the prior art have employed mechanical hinges with a hinge-pin, or a pair of split hinge-pins, for engaging the sides of the skimmer channel and with a rigid weir plate attached to the hinge. Buoyancy has been imparted to the generally rectangular weir plate by means of integral air spaces or by means of a buoyant body engaged in, or attached to, the plate proper. If the prior art hinge is too free, there is always the possibility that disturbances in the fluid level — as from waves generated by a person diving into a swimming pool — may cause over-rotation of the weir plate away from the pump suction chamber, and destroy its functionality until returned to the proper alignment.

It is, therefore, the primary object of the invention to provide a weir plate for a skimmer valve wherein the hinge is integral with the valve flap.

It is a further object of the invention to provide, in a weir plate of the integral hinge type, buoyancy uniformly distributed through the movable volume of the valve flap.

It is a further object of the invention to provide a weir plate for skimmer valves which are simple to manufacture, easy to install and to replace, and economical to distribute.

It is yet another object of the invention to teach the construction of self-hinging weir plates for skimmer valves, readily adaptable to skimmer channels of differing shapes, sizes and constructions.

SUMMARY

The invention attains the above objects, and others which will become apparent from the detailed description of its preferred embodiment below, by providing a weir plate of substantially rectangular shape, divided into two panels by an integral hinge line.

Preferably the weir plate is made from a semi-rigid, low density, sheet material of suitably expanded or foamed plastic composition wherein the required flexibility of the integral hinge is achieved by a locally densified structure of the sheet material.

For example, in one embodiment of the invention, the weir plate is manufactured from a sheet of expanded polyethylene plastic, with the hinge line formed near an end by a hot-pressed seam across the weir plate blank.

The weir plate is held in the skimmer channel by means of a mounting strip of rigid material, suitably of plastic composition, which may be held by fasteners engaging the base of the channel, or by frictional forces exerted against the sides or the roof thereof.

The location of the mounting strip generally coincides with a portion of the aforementioned hot-pressed seam, thereby ensuring that the material of the weir plate under the mounting strip is not exposed to undue deformations, and that the mounting strip is largely encompassed within the thickness of the weir plate and does not interfere with fluid flow over the metering edge of the weir.

In some materials, such as thin and flexible foamed elastomers, no pressed seam need be provided and the mounting strip may be used to compress the material to a reasonable rigidity at the hinge line.

DESCRIPTION OF THE DRAWINGS

The invention is illustrated with reference to the accompanying drawings, in which.

DESCRIPTION OF THE PREFERRED EMBODIMENT

Figure 1:
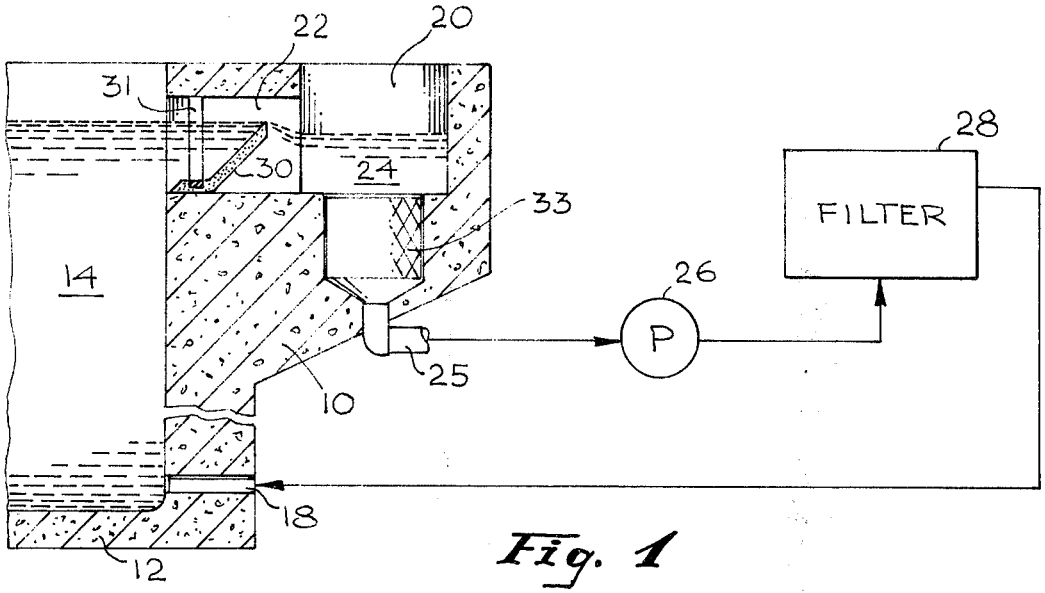
FIG. 1 is a partly schematic representation of a skimmer system for a swimming pool, or the like, employing a self-hinging weir plate of the invention to control the flow of water and debris from the pool proper into the pump inlet chamber.

The particular schematic view of FIG. 1 represents a transverse section through a swimming pool, with side walls 10, base 12 and retained water mass 14. Water taken from the swimming pool is continuously, or intermittently if so desired, circulated in a cleansing loop by a pump 26. The pump 26 draws water from an inlet chamber 20 — containing a body of water 24 — through a strainer 33 and suction pipe fitting 25; it is forced through a filter 28 prior to return into the main water body 14 via a discharge fitting 18.

The several parts of the cleansing loop perform different functions. The pump provides the motive force for water circulation, the strainer 33 removes debris — leaves and other gross matter tending to float on the surface of the water body 14 — while the filter 28 retains finely divided particulate matter in the circulating water.

An additional component of the cleansing loop — the skimmer — ensures that water is removed preferentially from the surface layer of the water body 14. This preferential flow permits the rapid removal of contaminating surface matter, before it has an opportunity to become waterlogged and settle into the lower reaches of the pool.

The skimmer includes a substantially rectangular, horizontally aligned skimmer channel 22 piercing the pool wall 10 and permitting water to flow from the body 14 into the pump inlet chamber 20. A weir plate 30 is interposed in the skimmer channel 22 to control the flow, induced by the pump suction, which maintains the elevation of the water surface in water body 24 at a slightly lower level than that prevailing in the main water body of the pool.

The weir plate 30 is arranged to permit rotational motion about a hinge-line along the bottom of the skimmer channel and at right angles to its principal dimension. This rotational motion coincides with the direction of water flow. The weir plate is, in addition, provided with excess buoyancy so that, in the absence of other forces, it would swing upwardly. With the pump operating, the differential head developed by the pump suction exerts a turning moment on the weir plate 30 and rotates it into an inclined position toward the pump suction chamber; the buoyancy of the weir plate is so designed that it will permit the upper edge of the plate to sink just slightly below the water surface in the body 14, thereby permitting a flow of water from the pool into the pump suction chamber. Since the plate is obstructing the lower portion of the skimmer channel 22, the flow is necessarily taken from the upper surface of the water body 14, justifying the appellation of the device as 'skimmer.'

With the pump shut down, the elevations of water masses in the pool and in the pump inlet chamber equalize and the weir plate is permitted to float upwardly until its upper edge emerges from the water surface. This second position is of great practical import; it prevents floating debris which has already reached the pump inlet chamber but not yet been removed from the strainer 33 from returning into the pool proper.

Figure 2:
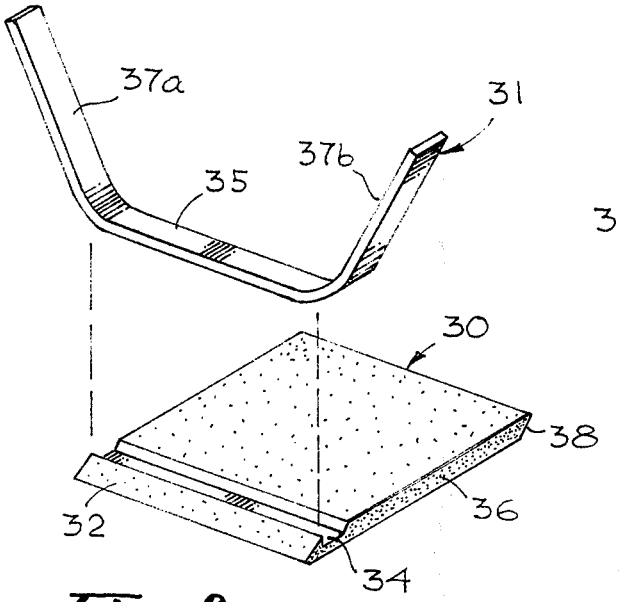
FIG. 2 is an exploded, perspective view of the weir plate of FIG. 1 and the retaining strip therefor.
Figure 3:
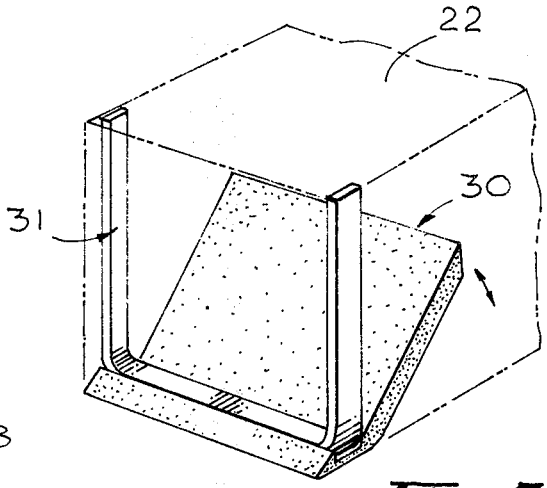
FIG. 3 is a perspective view of the assembly of FIG. 2 emplaced in the skimmer channel of FIG. 1.

The weir plate 30 and its retaining strip 31 are shown in greater detail in FIGS. 2 and 3. The perspective, exploded view of FIG. 2 shows the weir-plate 30 with a beveled leading edge 32, a hot-pressed groove 34 along that bevel, a main valve flap 36 of substantial uniform buoyancy and a metering edge 38, bevelled parallel to the leading edge 32.

The groove 34 is created by forcing a heated metal platen of the appropriate shape into the upper surface of the weir-plate blank and holding it at the position corresponding to the base of the groove for a short period of time. This operation partially melts the plastic or elastomeric material of the blank and compresses it into a more dense mass below the groove.

The material of the weir-plate 30 may be chosen from a wide variety of cellular plastics, or from similar — natural or synthetic — elastomers. Plastic compositions which have been found to give good service, in weir-plates according to the invention, include foamed closed-cell plastics having a density from about 1 to 4 pounds per cubic foot, as typified by expanded polyethylene. A particular product of the Dow Chemical Company — Ethafoam 220 — has been found very satisfactory; its density is around 2.2 pounds per cubic foot and its resistance to waterlogging is high.

Also shown in FIG. 2 is the retaining strip 31 made from an elongated member of elastic material, suitably a plastic such as high-density polyethylene or nylon. The retaining strip 31 is a substantially U-shaped member with base or hold down bar 35 and outwardly sloping legs 37*a* and 37*b*. The legs 37 may be bent inwardly until they are parallel to each other and perpendicular to the base segment 35; in this position the distance over the legs 37 is made substantially equal to the front width of the skimmer channel 22, which, in turn is the width of the weir-plate 30. The width and thickness of the retaining strip 31 correspond to the equivalent dimensions of the groove 34 in the weir-plate and, in the assembled position of FIG. 3, the base segment 35 is seated in the groove.

FIG. 3, as mentioned above, illustrates the assembled positions of the weir-plate 30 and the retainer 31 in the skimmer channel 22, shown in phantom outline only, corresponding to the operational alignment of FIG. 1. The weir-plate 30 is first laid on the floor of the skimmer channel with groove 34 upmost and the leading edge 32 toward the pool. The retaining strip 31 is then lowered into the groove, with its base 35 leading, the legs 37 bent inwards and the retainer forced upright. The vertical dimensions of the retaining strip, measured from the lower surface of the weir-plate to the tip of the legs 37 corresponds substantially to the height of the skimmer channel 22, so that the assembly is firmly wedged into the channel after the above assembly sequence. The spreading tendency of the legs 37 holds it firmly against the sides of the skimmer channel and its tips bear against the roof, pressing the weir-plate against the bottom of the channel.

The groove 34 is, advantageously, slightly wider than the retainer base 35, and is beveled rearwardly. This permits relative motion between the valve-flap 36 and the groove base, thereby forming an integral hinge around which the valve flap can rotate in response to the hydrostatic and hydrodynamic forces imposed on it by the water masses 14 and 24, and the flow induced by the pump 26.

Figure 4:
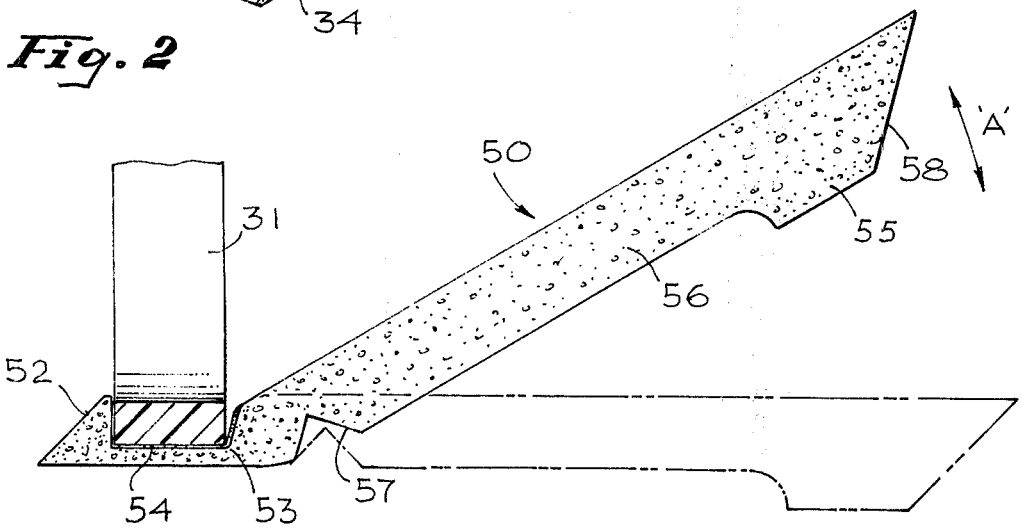
FIG. 4 is a transverse section through another embodiment of the weir plate of the invention, with provision for additional buoyancy.

The transverse section of FIG. 4 illustrates an alternate embodiment of the weir-plate of the invention wherein an integral float 55 is utilized to increase the buoyant moment of a weir-plate 50. Leading edge 52, groove 54, valve flap 56 and metering edge 58 correspond to the equivalent features of the weir-plate 30 and the valve-flap rotates around an integral hinge-point 53 at the rear seam of the groove 54. To impart greater flexibility to the valve flap, a triangular cut 57 is made transverse to the longitudinal axis of the weir-plate near the groove 54.

The additional buoyancy of the float 55 is placed near the tip of the valve-flap to provide the maximum possible moment around the hinge-line 53.

Figure 5:
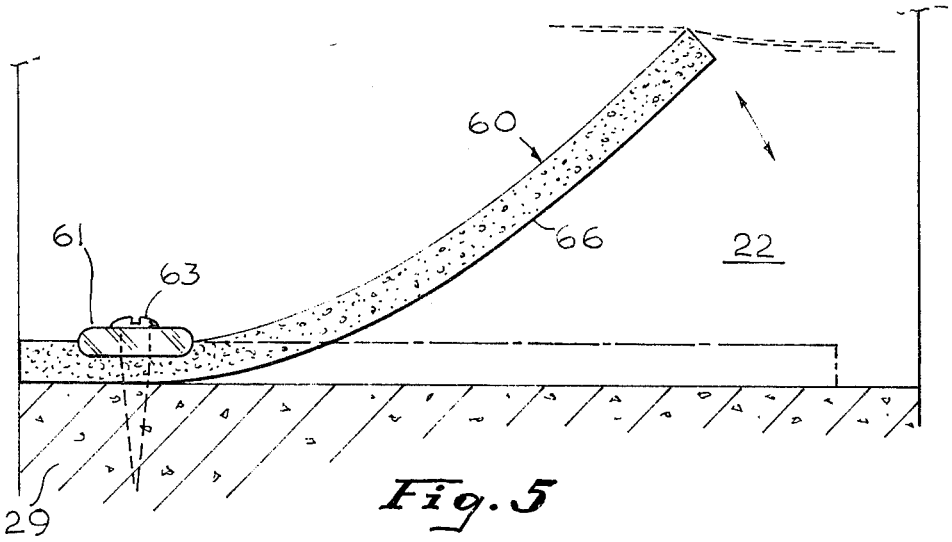
FIG. 5 is another transverse section through an alternate embodiment of the weir plate employing a rectangular section of buoyant, compressible material having a curved hinge portion, held by a retaining strip fastened to the base of the skimmer channel by threaded fasteners.

A very simple embodiment of the weir-plate of the invention is shown in the transverse elevation of FIG. 5. A weir-plate 60 is constructed from a closed-cell elastomer and is pressed and held against the bottom 29 of the skimmer channel 22 by means of a hold-down strip 61 secured by screws 63 into the material of the channel bottom 29.

Due to its compressibility, the thickness of the weir-plate 60 is reduced below the hold-down strip 61, and the intrinsic flexibility of the material provides a curved hinge which permits the downstream portion 66 of the weir-plate to act as a valve-flap and to rotate upwardly under the influence of buoyant forces. Such weir-plates may be constructed from conventional foamed plastic sheets ranging in thickness from ¼ to ½ inch, and more. They possess the advantage of requiring no machining save trimming to the proper lateral and longitudinal dimension.

Figure 6:
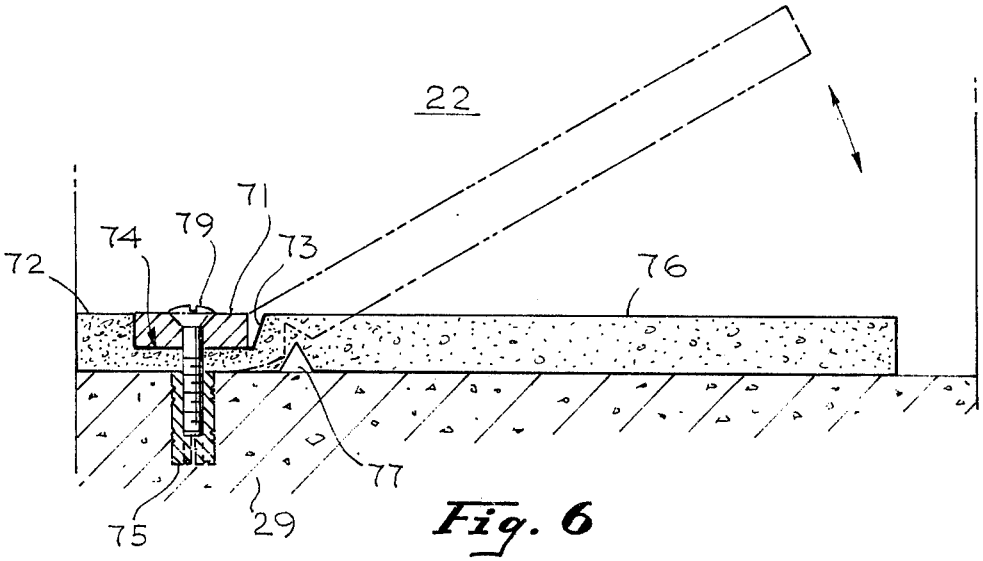
FIG. 6 shows a weir plate similar to the embodiment of FIG. 4, retained by a rigid hold-down strip.

The embodiment of the weir-plate shown in the transverse section of FIG. 6 combines an entrance section 72 with a valve-flap 76, divided from each other by a pressed groove 74 in which a retainer 71 is held by screws 79 passing through the retainer and the groove into expansion plugs 75 set into the base 29 of the skimmer channel 22. The groove 74 is angularly relieved towards the flap 76 and forms an integral hinge 73; a triangular cutout 77 reduces the rotational stiffness of the hinge plane.

Figure 7:
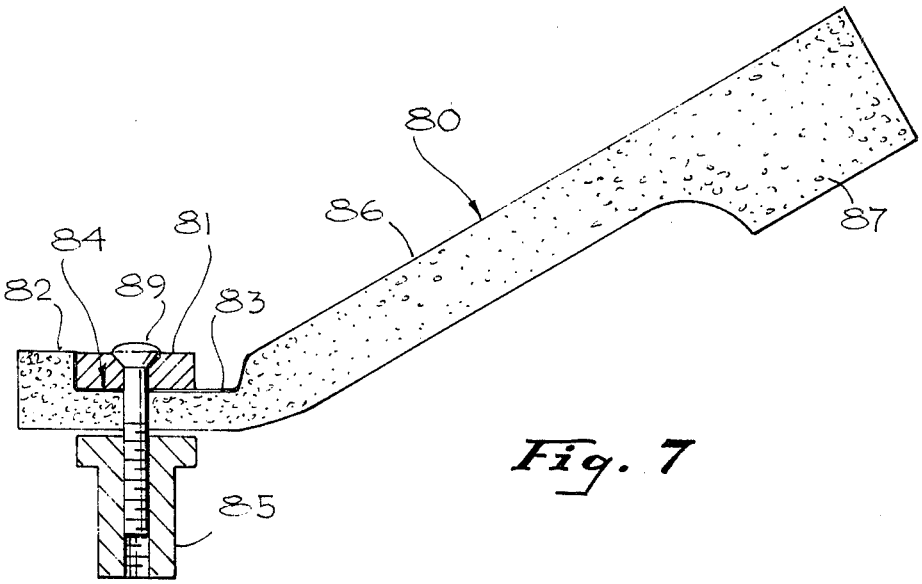
FIG. 7 is a transverse section through a further embodiment of the invention, providing for additional buoyancy and equipped with retaining means suitable for casting or molding into concrete or plastic skimmer channels.

The embodiment shown in the transverse section of FIG. 7 is particularly adapted for use with skimmer channels fabricated by casting or molding a temporarily liquid mass. Threaded inserts 85 are provided which may be placed into the form, or mold, prior to charging the liquid mass thereinto. The inserts 85 receive machine screws 89 which secure a mounting strip 81 into groove 84 of a weir-plate 80. The groove 84 is adjoined by a leading edge 82 on one side and by valve-flap 86 on the other. An enhanced, flexible hinge line is provided by increasing the width of the groove 84 to a larger dimension 83 than required for receiving the mounting strip 81. The valve-flap 86 terminates at its outer end in a downwardly extending, expanded portion 87.

The invention has been described above with reference to a number of embodiments of the weir-plate and of the securing means therefor. One skilled in the art will recognize other constructional details and/or combinations which may be employed in providing a suitable control device for use in skimmer valves without departing from the teachings herein.

Such details may involve the choice of different materials, provided that the requirements for proper operation are met, namely, low density, freedom from water logging and sufficient resiliency for self-hinging action. Other details may involve changes in the cross-sectional development of the weir-plate and changes in the means of attachment to the base of the skimmer channel.

Such changes shall be deemed to be encompassed by the present disclosure, delimited only by the appended claims.

That which is claimed is:

1. A one piece self-hinging, buoyant, skimmer weir for skimmers employed in swimming pools, and the like, comprising:

a substantially rectangular weir plate constructed from a substantially homogeneous, low-density, cellular material; and means for retaining said weir plate along a seam on the upper surface thereof, said seam being a groove disposed transverse to the direction of liquid flow in said skimmer proximate to the base of said weir plate and said retaining means being cooperatively disposed in said groove.

2. The weir of claim 1 wherein said material is a closed-cell, foamed elastomer and said retaining means include a rigid, elongated retainer.

3. The weir of claim 2, wherein said retainer is held in position by threaded fasteners passing therethrough, and through said weir plate, into the base of the skimmer.

4. The weir of claim 2 wherein said retainer is provided with upwardly extending projections at the ends thereof for frictionally engaging the side walls of the skimmer.

5. The weir of claim 1 wherein said material is a yieldable foamed plastic composition, and said retaining means includes a hold-down bar disposed in said groove.

6. The weir of claim 5 wherein said groove is a hot-pressed depression in the upper surface of said foamed plastic composition.

7. The weir of claim 5 wherein said material is a closed-cell polyethylene foam and the groove extends rearwardly in slight excess of the width of the hold-down bar.

8. The weir of claim 7 wherein the density of said foam is in the range between 1 and 4 pounds per cubic foot.

9. The weir of claim 5 further comprising an integral float volume near the edge of said weir plate furthest from said groove; said volume protruding away from said upper surface.

10. The weir of claim 5 wherein said hold-down bar is held in position by threaded fasteners passing therethrough, and through base of said groove, into said base of the skimmer.

11. The weir of claim 5 wherein said hold-down bar is provided with upwardly extending projections at the ends thereof for frictionally engaging the side walls of said skimmer.

* * * * *